United States Patent [19]

Rey

[11] 4,284,403

[45] Aug. 18, 1981

[54] ACOUSTIC LEVITATION AND METHODS FOR MANIPULATING LEVITATED OBJECTS

[75] Inventor: Charles A. Rey, Naperville, Ill.

[73] Assignee: Intersonics Incorporated, Northbrook, Ill.

[21] Appl. No.: 949,070

[22] Filed: Oct. 6, 1978

[51] Int. Cl.[3] ..... F24J 3/00

[52] U.S. Cl. ..... 432/1; 181/0.5; 248/1; 414/787; 432/11; 432/121; 432/266

[58] Field of Search ..... 432/1, 266, 121, 11; 181/0.5; 248/1; 414/787

[56] References Cited

U.S. PATENT DOCUMENTS

| | | | |
|---|---|---|---|
| 3,164,022 | 1/1965 | Ensley | 181/0.5 X |
| 3,232,120 | 2/1966 | Ensley | 181/0.5 |
| 3,882,732 | 5/1975 | Fletcher | 73/505 |

OTHER PUBLICATIONS

Whymark, "Acoustic Field Positioning for Containerless Processing," Nov. 1975.

Wang et al., "Arrangement for Producing Rotational Effects on Acoustical Suspended or Positioned Samples," Jul. 24, 1975.

Elleman et al., "Acoustic-Energy Shaping of Meltable Metals," Jan. 1977.

Whymark et al., "Acoustic Levitation Materials Processing System," Jan. 1979.

*Primary Examiner*—John J. Camby

*Attorney, Agent, or Firm*—Gary, Juettner & Pyle

[57] ABSTRACT

Objects are levitated in a sound system substantially free of reverberation and reflection by positioning a small reflector in the path of sound waves. Interference between the primary waves and reflected waves creates a localized zone of minimized energy closely adjacent to the reflector in which an object may be stably levitated. The energy well thus produced is not dependent upon distance from the sound source, and the levitated object may be moved in any direction by moving the reflector. A plurality of reflectors may be employed to manipulate and combine levitated materials, and improvements in the processing of levitated objects are also achieved.

14 Claims, 9 Drawing Figures

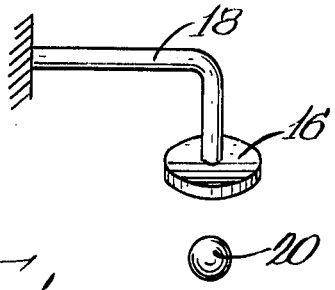
Fig. 1.
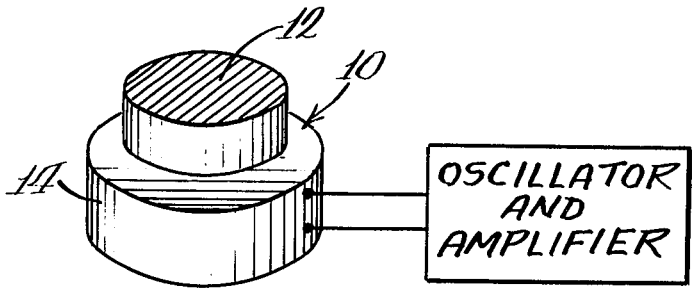
Fig. 2A.
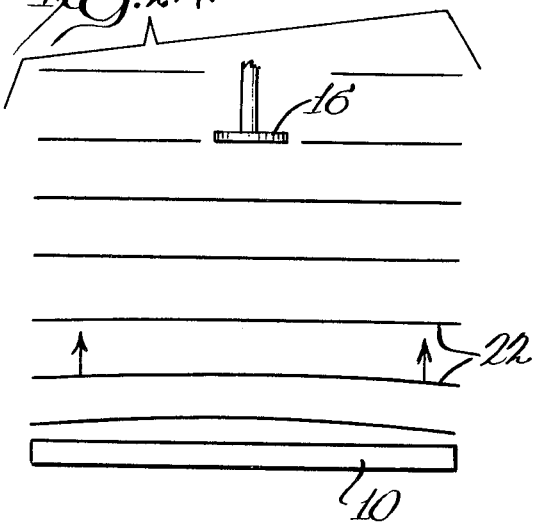
Fig. 2B.
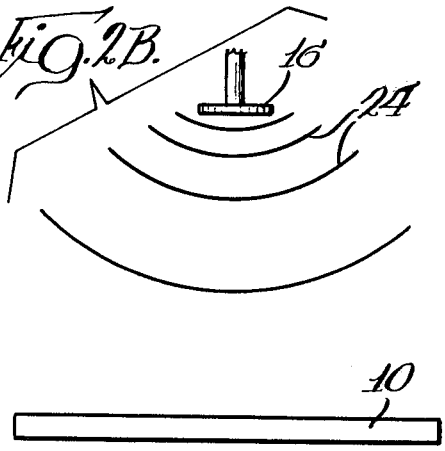
Fig. 2C.
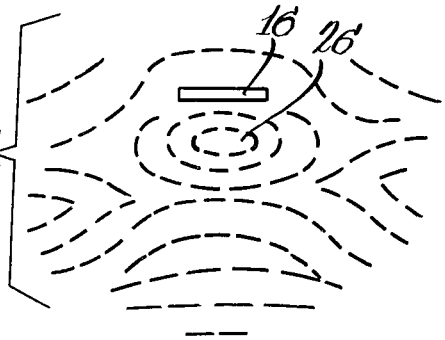

ACOUSTIC LEVITATION AND METHODS FOR MANIPULATING LEVITATED OBJECTS

BACKGROUND OF THE INVENTION

The principles of acoustic levitation are well established. It is known that sound exerts a small but continuous force on materials in a sound field over and above the pressure oscillation occuring at that frequency. Various schemes have been devised whereby such continuous forces are maximized sufficiently to enable small objects to be suspended in a sound field without visible means of support.

The potential applications for acoustic levitation, positioning and manipulation are numerous and varied. Many potential applications exist whenever there is a need to hold, move, store or position an object without contact with any surface, particularly if such contact would contaminate or damage the object or otherwise interfere with some desired property or state of the object. For example, an object that is melted by conventional means at high temperatures will be contaminated by the container, and acoustic levitation offers the possibility of containerless melting as well as other containerless or non-contact processing involving, for example, chemical reaction, alteration of physical shape, coating, combining, conveying, and the like.

Acoustic levitation also lends itself to manufacturing processes in outer space by preventing drift of the materials being processed. In this connection, several proposals have already been made for the processing of acoustically positioned objects in future space stations.

Of the acoustic levitation systems heretofore proposed, all have exhibited serious drawbacks or limitations that affect practical usage or otherwise restrict performance under a variety of conditions. All previous systems utilize resonant cavities that must be carefully tuned and because of the cavity nature are limited in physical geometries. For example, U.S. Pat. No. 3,882,732 describes a resonant rectangular chamber utilizing three sound transducers arranged in three normal axes. The system is used to establish a standing wave pattern to urge an object toward a zone of minimum pressure. Tuned cylindrical chambers have also been proposed but similarly suffer from the requirement to be tuned.

In another proposed system, a single sound source is used, and a large reflector is placed at a critical distance from the sound source to produce standing waves.

In all of the foregoing, the geometry of the system is critical and variations in temperature cause the system to detune. If a reflective surface is used to produce a standing wave, the distance between the sound source and reflective surface must be maintained at n (x/2), where x is the wavelength of the sound, and n is a whole number. If the temperature should change, the wavelength of the sound is also changed. As a result, the system will no longer be in resonance, the standing wave will be destroyed, and the levitation will be lost.

SUMMARY OF THE INVENTION

The present invention provides an acoustic levitation system which is characterized by being independent of critical resonance and geometry limitations inherent in prior systems. The system comprises a primary source of sound waves typically having a single frequency, and a limited size reflector, i.e., in the order of less than 3 or 4 wavelengths of the sound in mean diameter, said reflector at least partially facing the primary source of sound. The small size of the reflector minimizes or eliminates resonance between the primary source and the reflector. At the same time, however, unexpectedly there is created a localized energy well closely adjacent to the reflector that is presumably caused by local interference between the primary and reflected waves. Since neither the sound source nor cavity walls play a role in re-reflecting sound waves to produce a standing wave, the energy well described above is entirely independent of distance between sound source and reflector, which was a serious limitation in prior devices.

In addition, since the system is not dependent upon maintenance of a resonant cavity of any sort, variations in the temperature of the gas and hence the velocity of sound therein do not seriously affect the operability of the system.

Other advantages will become apparent from the following detailed description:

THE DRAWINGS

FIG. 1 is a simplified perspective view of an acoustic levitation device made in accordance with the teachings of the present invention.

FIGS. 2A, 2B and 2C are schematic views illustrating patterns of sound waves involved in the present invention.

DESCRIPTION OF THE PREFERRED EMBODIMENT

Figure 3:
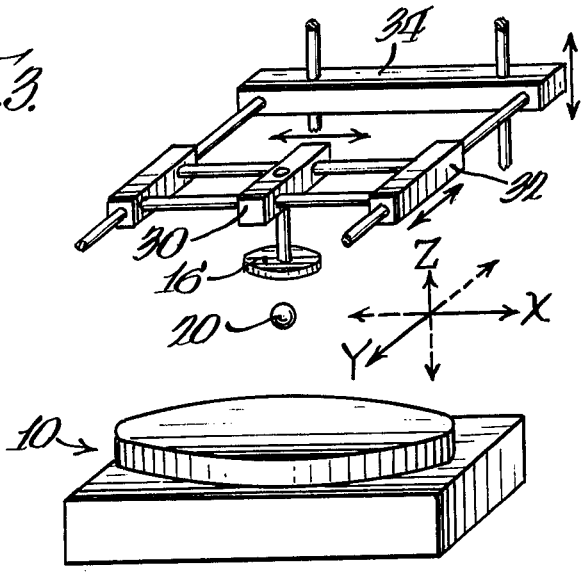
FIG. 3 is a simplified schematic view of a device of the present invention illustrating movement of the reflector and levitated object to various positions in the sound field.
Figure 4A:
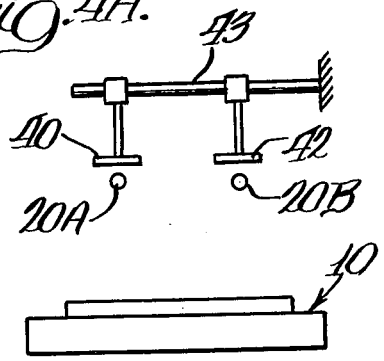
FIGS. 4A, 4B and 4C are schematic views illustrating various positioning and manipulating techniques available in connection with the present invention.
Figure 4B:
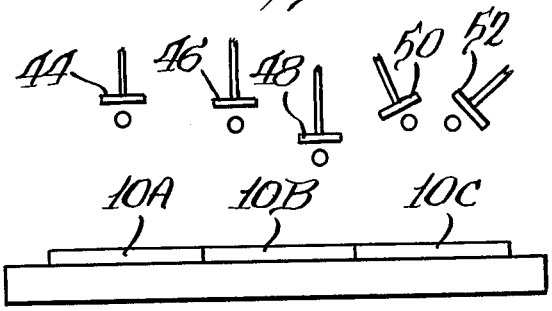
Figure 4C:
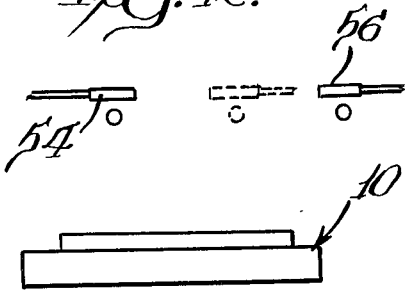

As shown in FIG. 1, the apparatus required in connection with the present invention is very simple. Means, generally indicated at 10, are provided for creating a source of sound waves, preferably at a fixed frequency, although the frequency employed is not at all critical, and for example, may range in the order of a few hertz to in excess of 100 kilohertz. Various intensities may be employed. The sound device shown at 10 is of a conventional construction and includes a solid cylindrical metal mass or piston 12 having a length equal to one half sound wavelength in the metal. The piston 10 is oscillated by inducing eddy currents in a metal tube 14 turned integrally with the base of the source and operatively connected to an oscillator and amplifier as shown. Full details regarding the construction of the sound source are described in *Sonics,* Heuter, T., Bolt, R. H., Wiley, New York (1955).

Although the piston-type sound source described above is preferred because of the relatively high sound intersities that may be attained, it will be apparent that other continuous sound producing sources, such as loud speakers, piezoelectric, magnetostrictive transducers, and the like, may be successfully employed.

It will be understood that the propogation of sound from source 10 requires the presence of a sound propogating fluid, which is usually a gas or mixture of gasses or fluids. The pressure of the gas may be adjusted as desired by disposing the apparatus in a sealed enclosure having a valved inlet and outlet (not shown).

The apparatus of the present invention also includes a suitably designed reflector 16 that is spaced from the sound source 10 and has a substantial portion of the reflective surface thereof facing the sound field from source 10. The reflector 16 may be of any desired shape and surface configuration but is limited in size to a mean diameter of less than 3 or 4 wavelengths of the sound from source 10 and preferably has a mean diameter of less than one or two wavelengths, for the reasons to be described more fully herein. Suitable means 18 are provided to support the reflector 16. The support means 18 may be fixed or movable, as will be described herein in detail.

It may be seen in FIG. 1 that when the apparatus is activated, any desired object 20 may be suspended or acoustically levitated at a given position below the reflector 16. The object may be solid or liquid of any shape and will have a size less than the size of the reflective surface of the reflector.

The theory of operation of the FIG. 1 apparatus is illustrated schematically in FIGS. *2a, 2b* and *2c*. In FIG. *2a* it may be seen that the sound source 10 continuously generates high intensity sound waves 22 which move in a direction away from the source and which become essentially planar a short distance from the source.

As shown in FIG. *2b* sound waves which strike reflector 16 are reflected therefrom as shown schematically at 24, the reflector essentially acting as a small, independent source of sound. The size of the reflector is sufficiently small relative to the sound field such that the reflected waves are quickly scattered and dissipated to substantially prevent any resonance.

Unexpectedly, however, it has been found that a resonance independent energy well is created closely adjacent the reflector 16, presumably because of localized interference between the primary 22 and secondary 24 waves in the near vicinity of the reflector, i.e., less than one-half wavelength from the reflective surface. The resultant theorized interference pattern is shown in FIG. *2c*, and it may be seen that an energy well 26 or region is created wherein the acoustic potential energy is relatively less than the immediate surrounding region. Objects placed in this location, which have a maximum determinable size and total mass, will be held in three dimensions in the energy well 26.

The establishment of the energy well described above is dependent upon the size of the reflector, and the size must be less than a value that would cause any substantial resonance in the system. If a larger reflector were used, sound waves would be reflected in sufficient degree to cause resonance that would disrupt the energy well.

By substantially eliminating resonance in the system, extremely important benefits are achieved. Since the distance between the sound source and reflector is not at all critical, the reflector may be moved in any direction to any position in the sound field and the levitated object will be moved therewith. Also, a plurality of reflectors each with their own localized energy well, may be introduced into the sound field to position, move or combine a plurality of levitated objects, which is a result that has not heretofore been achieved. In addition, there is no need to adjust the frequency to obtain resonance, and a change in temperature of the gas will not disrupt the levitation.

FIG. 3 illustrates a simplified form of apparatus that may be used to move the reflector 16 in any position in the field of sound whereby the levitated object 20 will be also moved. As shown, the apparatus comprises the reflector 16 having the non-reflective side thereof connected to a X-axis slider 30 which is in turn operatively connected to a y-axis slider 32, which in turn is operatively connected to a z-axis slider 34. The reflector 16 and associated object 20 may therefore be positioned in any desired spacial location relative to the sound source 10 without loss of the levitated object. Although the means illustrated for moving the reflector are mechanical, it is apparent that other means could be employed, such as fluid or magnetic, to move or assist the movement of the reflector.

FIG. *4a* illustrates the levitation of a plurality of objects 20*a* and 20*b* in a single sound field by means of fixed reflectors 40 and 42 connected to a support 43 in a spaced relation to the sound source 10.

FIG. *4b* illustrates the possibility of an extended sound field to position or move any number of objects as desired. For example, a plurality of adjacent sound surces 10*a*, 10*b* and 10*c* may be used to create an extended sound field within which a plurality of reflectors 44, 46, 48, 50 and 52 may be employed to convey, position or manipulate a number of objects. It may be seen that the reflector 46 is employed to levitate a plurality of objects. Also, it may be seen that the reflectors may, as shown at 50 and 52, have their reflective surfaces somewhat tilted out of parallel with the sound source without loss of the energy well. Thus, reflectors 50 and 52 could be brought together in order to combine the objects levitated thereby.

FIG. *4c* illustrates another method of combining two levitated objects such as liquid drops. The two reflectors 54 and 56 having respective levitated drops may be moved together until the drops combine, and one of the reflectors may be moved away or rotated out of position whereby the combined drop will be levitated under a single reflector.

Figure 5:
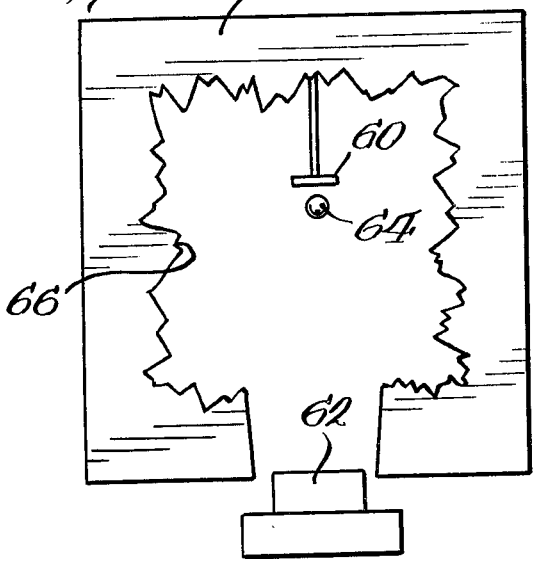
FIG. 5 is a cross sectional view of a furnace for heating a levitated object in accordance with the present invention.

FIG. 5 illustrates the heating and/or melting of a levitated object in the heated interior of a furnace 58. A small reflector 60 is supported within the furnace and faces a sound source 62 directed through an opening in the other side of the furnace, whereby the object 64 may be heated or melted.

The scheme shown in FIG. 5 has important advantages over systems that utilize resonance for levitation. As the temperature of the gas increases, the velocity of sound in the furnace increases, which would cause loss of resonance and accurate levitation of the object if adjustments were not made. In the system shown in FIG. 5, an increase in temperature simply causes the object to move somewhat further from the reflector but the localized energy well is not disturbed.

It may also be seen that the interior wall 66 of the furnace 58 may be provided with a randomly irregular surface to further minimize reflection an resonance within the cavity of the furnace.

As a specific example of the method and apparatus described herein, a sound source of 15 khz with a diameter of 2 inches and operating at about 140 db intensity was employed. The end of a $\frac{3}{8}$ inch rod was introduced as a reflector at a spaced relation from, and facing the sound source. It was observed that small plastic spheres up to $\frac{1}{4}$ inch in diameter and having a density of 0.2 gm per $cm^3$ would be levitated about 0.3 inch from the surface of the reflector. It was observed that a substantial decrease in sound intensity would cause the spheres to fall out of the energy well and that an increase in intensity would cause the spheres to be more rigidly locked in the well. It was found that the reflector rod could be moved closer or further from the sound source and that the levitated object would stay a fixed distance from the end of the rod. Also, the rod could be translated in directions other than parallel to the sound axis while maintaining the levitation of the sphere. Further, the reflector could be rotated so that the normal to the flat end deviated up to about 50 degrees from being parallel to the sound axis. In all these motions and positions the sphere remained locked in the energy well.

In the foregoing embodiments, the reflector has been shown positioned above the sound source, although the entire system may be oriented in any fashion, e.g., with the sound source at the top or at one side.

From the foregoing, it may be seen that the improved sound levitation system of the present invention is particularly suited to various manufacturing process that have not been possible in previously known systems.

What is claimed is:

1. An acoustic levitation system comprising source means for producing a field of sound having a wavelength, and reflector means spaced from said source means for producing localized reflection of a portion of sound, said reflector means having an effective reflecting surface of a size less than four wavelengths of the sound such that said system is substantially free of resonance and such that a localized energy well is created adjacent said reflector means capable of levitating an object.

2. The acoustic levitation system of claim 1 wherein the reflector means has an effective reflective surface having a size less than one wavelength of said sound.

3. The acoustic levitation system of claim 1 further comprising means for moving said reflector means within said field of sound.

4. The acoustic levitation system of claim 1 comprising a plurality of separate reflector means in said field of sound.

5. The acoustic levitation system of claim 1 further comprising means for heating said object.

6. The system of claim 5 wherein the means for heating said object comprises an enclosure having irregular surfaced interior walls.

7. The system of claim 4 further comprising means for moving one reflector means toward a second reflector means whereby respective objects supported thereby will be brought into contact.

8. A method for acoustically levitating an object comprising the steps of producing a field of sound, interposing a sound reflector in said field of sound, said sound reflector being sufficiently small to substantially prevent resonance and to create a localized energy well adjacent to the sound reflector, and disposing said object in said energy well to acoustically levitate said object.

9. The method of claim 8 comprising the additional step of moving said object by moving said sound reflector in said field of sound.

10. The method of claim 9 comprising the steps of interposing a plurality of sound reflectors in said field of sound to levitate a plurality of objects.

11. The method of claim 10 comprising the additional step of moving one of said sound reflectors to the other.

12. The method of claim 11 comprising the additional step of combining one object with another.

13. The method of claim 8 comprising the step of changing the temperature of the levitated object.

14. An acoustical levitation system comprising a field of sound in a fluid and a localized energy well means therein for acoustically levitating an object, said energy well means being substantially independent of resonance and frequency of said sound and temperature changes in said fluid.

* * * * *